United States Patent [19]

Bateman

[11] Patent Number: 4,863,125

[45] Date of Patent: Sep. 5, 1989

[54] FLEXIBLE DISPENSER FOR BAGS

[75] Inventor: Robert Bateman, Morristown, Tenn.

[73] Assignee: Lin Pac, Inc., Atlanta, Ga.

[21] Appl. No.: 205,318

[22] Filed: Jun. 10, 1988

Related U.S. Application Data

[63] Continuation-in-part of Ser. No. 854,089, Jun. 12, 1986, Pat. No. 4,750,694.

[51] Int. Cl.[4] ..... A63B 55/04

[52] U.S. Cl. ..... 248/97; 16/308; 248/100; 248/175

[58] Field of Search ..... 248/97, 95, 99, 100, 248/101, 153, 175; 211/50, 49.1; 141/139; 16/307, 308

[56] References Cited

U.S. PATENT DOCUMENTS

| | | | |
|---|---|---|---|
| D. 264,650 | 6/1982 | Adamson . | |
| D. 264,651 | 6/1982 | Adamson . | |
| D. 264,653 | 6/1982 | Adamson | D6/114 |
| D. 264,905 | 6/1982 | Adamson . | |
| D. 273,159 | 3/1984 | Adamson et al. . | |
| 1,248,132 | 11/1917 | Katzenberg | 16/307 |
| 1,922,938 | 8/1933 | Elliot | 248/97 |
| 2,391,861 | 1/1946 | Bellows | 16/307 X |
| 3,779,496 | 12/1973 | Welles | 248/99 |
| 3,823,630 | 7/1974 | Suominen et al. . | |
| 3,858,382 | 1/1975 | Suominen . | |
| 4,106,734 | 8/1978 | Walitalo . | |
| 4,174,085 | 11/1979 | Ferreira et al. | 248/97 |
| 4,193,164 | 3/1980 | Okayama | 16/307 X |
| 4,199,122 | 4/1980 | Christie . | |
| 4,241,561 | 12/1980 | Suominen | 53/390 |
| 4,304,378 | 12/1981 | Briggs | 248/97 |
| 4,305,558 | 12/1981 | Baker . | |
| 4,316,353 | 2/1982 | Suominen . | |
| 4,332,361 | 6/1982 | McClellan . | |
| 4,363,405 | 12/1982 | Christie . | |
| 4,372,512 | 2/1983 | Wolfe . | |
| 4,378,924 | 4/1982 | Christensen . | |
| 4,398,689 | 8/1983 | Prader | 248/99 |
| 4,458,867 | 7/1984 | Malik . | |
| 4,487,388 | 12/1984 | Provan . | |
| 4,498,652 | 2/1985 | Malik . | |
| 4,750,694 | 6/1988 | Bateman | 248/97 |

*Primary Examiner*—Ramon O. Ramirez
*Attorney, Agent, or Firm*—Kilpatrick & Cody

[57] ABSTRACT

Flexible bag dispensers for plastic bags such as those used to carry merchandise purchased in grocery stores or hardware stores. The dispensers are generally "w"-shaped to form two cells in order to dispense two sets of bags. The frame is formed by a back portion which connects three or more side portions which support the bags. Flexion members such as spring-loaded hinges may be mounted to and connect members in the back portion, one or more side portions, or at intersections between one or more side portions and the back portion to allow the side portions to flex when a person or object impacts the dispenser.

2 Claims, 2 Drawing Sheets

FLEXIBLE DISPENSER FOR BAGS

This is a continuation-in-part of my application no. 854,089 filed June 12, 1986 U.S. Pat. No. 4,750,694 for "Adjustable Dispenser Bags" which is incorporated herein by reference.

This invention relates to dispensers for flexible bags such as bags used to carry merchandise purchased in grocery stores or hardware stores. Dispensers according to the invention contain flexion members to allow the dispensers to flex when impacted as, for instance, when checkout personnel or customers contact the dispensers.

BACKGROUND OF THE INVENTION

Grocery stores, hardware stores and other merchants recently began using flexible plastic bags as containers for customers' purchases. The transition from paper bags to plastic bags can be attributed to many reasons, including economies of cost, storage and transportation space, and the facts that plastic bags have handles and do not rip or tear as easily as paper bags. Whatever the cause is for this change, plastic bags differ from paper bags in one major respect: they cannot support themselves while being filled with merchandise. Accordingly, plastic bags require merchants to utilize bag dispensers to store such bags and to hold them open in a convenient manner while being filled with merchandise.

Shopping bag dispensers formed of wire are frequently used to support such bags. Sides of such racks support the walls of the shopping bag being filled and have at their upper extremeties suspending means about which bag handles may be placed while a bag is being filled.

Wire bag dispensers are usually mounted at the ends of checkout counters or other places where the bags they contain can be easily loaded and easily picked up and carried off by the customer. For this reason and because the dispensers are typically mounted lower than waist high, checkout personnel and customers sometimes bump into the dispensers.

SUMMARY OF THE INVENTION

The present invention places flexion members in bag dispensers so that portions of the dispensers give flex when impacted. Such dispensers thus minimize any discomfort which may be experienced by checkout personnel or customers when they contact the dispensers.

According to one embodiment of the invention, one or more spring-loaded hinges support extremeties of the dispenser so that they may pivot and give way when impacted. The hinges then rotate the pivoted member back into place.

It is therefore an object of the present invention to provide a dispenser for flexible bags which stores bags in a convenient and easily accessible manner, which supports the bag while being loaded and which is flexible to reduce discomfort to those who impact such dispensers.

It is an additional object of the present invention to provide a flexible dispenser for flexible bags which is inexpensive, portable, and economical and efficient to use.

Other objects, features and advantages of the present invention will become apparent with reference to the remainder of the specification, including the claims and the drawings.

DETAILED DESCRIPTION OF THE DRAWINGS

Figure 1:
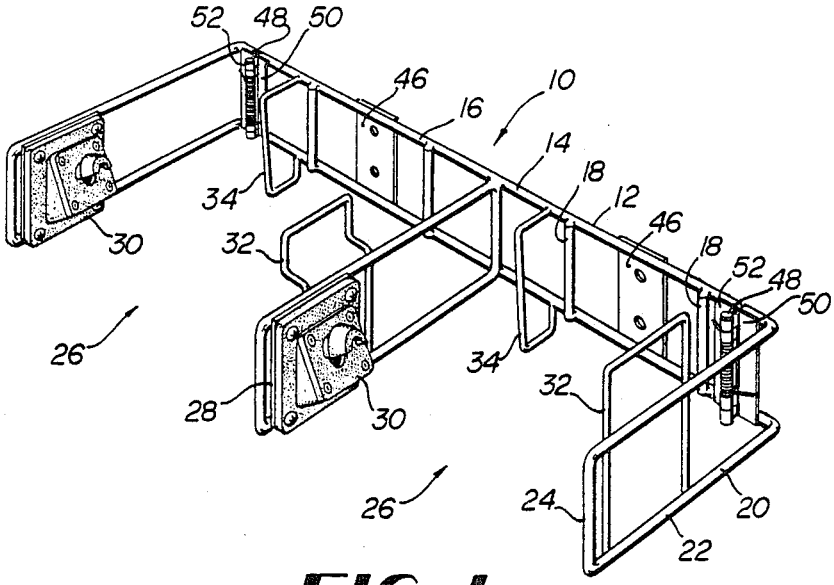
FIG. 1 is a perspective view of a dispenser according to a first embodiment of the present invention.
Figure 2:
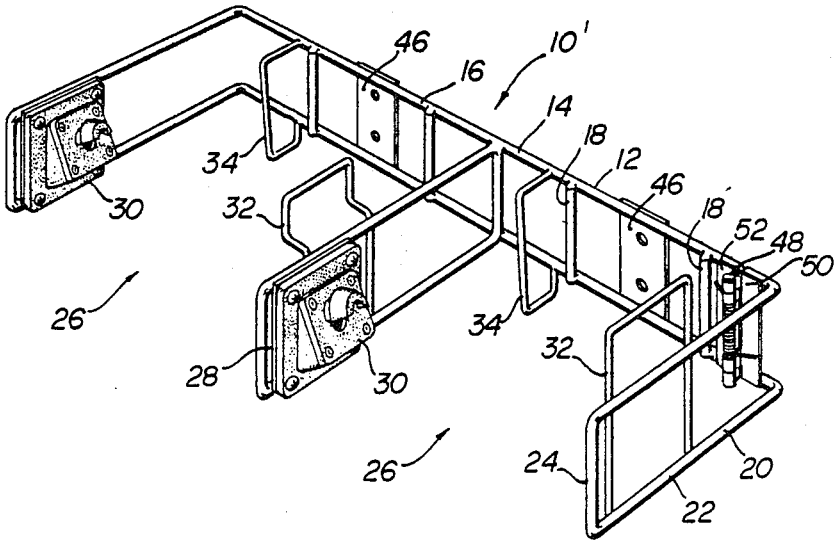
FIG. 2 is a perspective view of a dispenser according to a second embodiment of the present invention.

FIGS. 1 and 2 illustrate a first embodiment of a dispenser 10 according to the present invention. Frame 12 of the dispenser is generally formed in the shape of the letter "w." Frame 12 comprises a back portion 14 which is formed of a plurality of lateral members 16 which may be connected together by a plurality of uprights 18.

Figure 3:
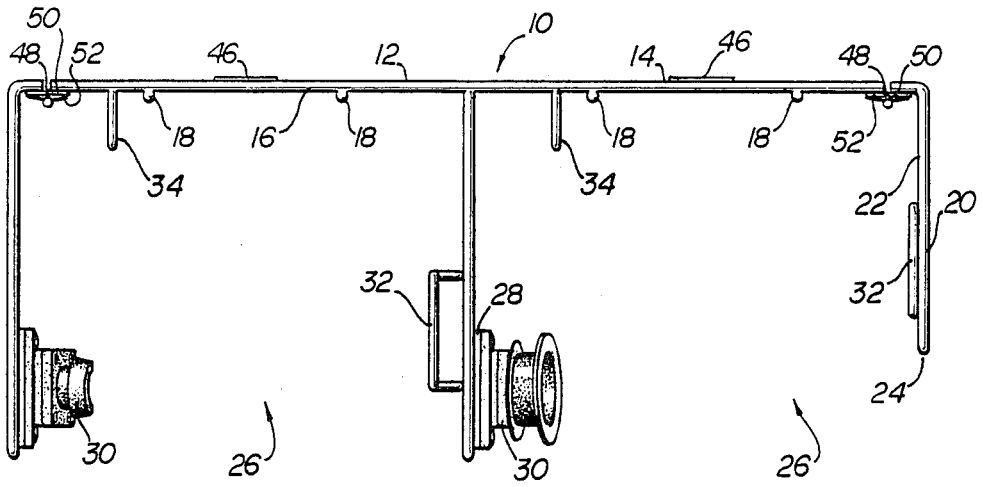
FIG. 3 is a top-plan view of the dispenser of FIG. 1.

The dispenser of FIGS. 1 and 3 contains three side portions 20 which are connected to back portion 14 and extend generally orthogonally from it. Each side portion 20 is formed of horizontal members 22 which may be connected by one or more side portion uprights 24. Side portions 20 may, for instance, be formed by loops of wire which are bent to form horizontal members 22 and side portion uprights 24.

Two of the side portions 20 (a first and third side portion 20) are connected generally to the ends of back portion 14 while the other side portion 20 (the second) is connected generally to the middle of back portion 14. This configuration forms two cells 26, each for supporting a bag. Obviously, fewer or more side portions 20 may be used to form one or more cells 26.

Two of the side portions 20 of the illustrated embodiment serve as mounting surfaces for a flange 28 which may be a metal plate of appropriate size and with appropriate openings for connection to a bag support means 30. The flanges 28 may be welded or otherwise connected to the side portions 20.

Bag support means 30 may be receivers as disclosed in the parent of this document, or other appropriate means for supporting storing and dispensing a stack of plastic bags to be used in the dispenser. Bag support means 30 may be bolted or otherwise connected, adjustably or non-adjustably, to flange 28.

The side portion 20 that cooperates with another side portion 20 to form a cell 26 serves as the mounting surface for a suspending member 32 that receives the handle of a bag not supported by the bag support means 30. Suspending member 32 may be a loop of wire or bends in portions of the side portion horizontal members 22.

Each cell 26 may contain a retainer 34 for retaining in place bags stored on bag support means 30. Retainers 34 may simply be loops of wire which are welded or otherwise attached to back portion 14.

Figure 4:
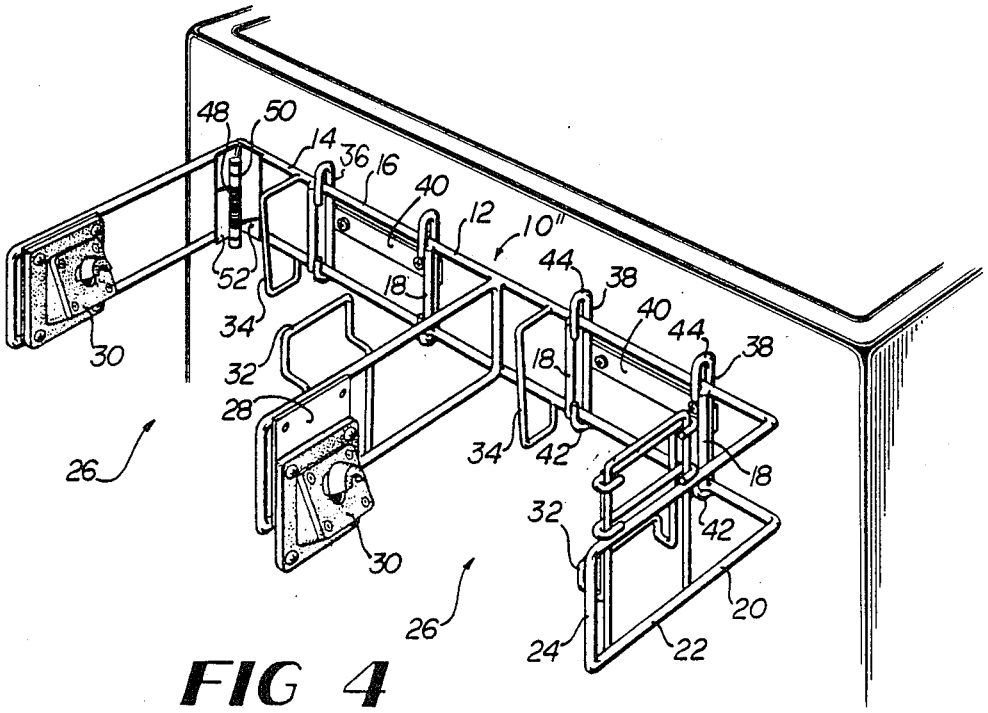
FIG. 4 is a perspective view of a dispenser according to a third embodiment of the present invention mounted to a vertical surface.

Frame 12 may be connected to a mounting surface such as checkout counter or a wall by use of mounting brackets 36 as shown in FIG. 4. Mounting brackets 36 comprise a plurality of generally "c"-shaped hooks 38 held together by a bracket frame 40 which runs between and connects the hooks 38. In the embodiment shown in FIG. 4, lower hook portions 42 of c-shaped hooks 38 are shorter than the upper hook portions 44. Lateral members 16 of dispenser frame 12 may be slid upwardly into upper hook portions 44. Frame 12 is then rotated to vertical and allowed to slide down into lower hook portions 42 so that both upper hook portions 44 and lower hook portions 42 capture frame 12 to hold dispenser 10 into place. Alternatively, frame 12 can be mounted to the supporting surface by one or more mounting flanges 46 which can be plates with appropriate mounting holes that are welded otherwise connected to back portion 14 of frame 12.

Frame 12 according to the present invention contains one or more flexion members 48 to allow frame 12 to flex when impacted by a person or object. The frame 12 of FIG. 1 contains two spring-loaded hinges 50 for this purpose. Each hinge 50 is located at a break in back portion 14 near the end side portions. 20. Lateral members 16 may be cut or otherwise interrupted at the mounting locations for hinges 50 and the hinges 50 welded or otherwise attached to the remaining sections of lateral members 16 or other members of the back portion 14. Hinges 50 contain springs sufficiently strong to maintain a reasonable degree of rigidity for dispenser 10 as it is being used to load bags. In the embodiment shown in FIG. 1, hinges 50 are fully opened when hinge flanges 52 are parallel to one another. Flexion members 48 can be located on the side portions 20 rather than back portion 14, at the intersection of side portions 20 with back portion 14 or at any other desirable location to make frame 12 flexible as desired.

FIG. 2 shows a dispenser 10 having one flexion member 48 while FIG. 4 shows a dispenser 10 which has a flexion member 48 located at an intersection between a side portion 20 and back portion 14.

The foregoing is provided for purposes of explanation and illustration. It will be apparent to one skilled in the relevant art that modifications and changes may be made to the invention as thus described without departing from its scope and spirit.

What is claimed is:

1. A flexible dispenser for bags, comprising:

(a) a generally "w"-shaped frame comprising:

(i) a back portion comprising a plurality of lateral members connected by a plurality of uprights;

(ii) a first, second and third side portion extending generally orthogonally from the back portion, each side portion comprising a plurality of horizontal members connected by at least one upright, the first and third side portions extending from the lateral ends of the back portion;

(b) a receiver connected to each of the first and second side portions, for supporting, holding and dispensing a plurality of plastic bags;

(c) two suspending members, each attached to the second and third side portions, for capturing a hole in a bag positioned in the dispenser; and (d) at least one spring loaded hinge that divides the back portion of the frame into two sections, which hinge has two flanges, each of which flanges is connected to a section of the back portion of the frame to allow the frame to flex when contacted by people or objects, and which flanges do not open beyond parallel so that the side portions of the frame do not flex beyond the point at which they are substantially parallel to one another.

2. A flexible dispenser for bags, comprising:

(a) a generally "w"-shaped frame comprising:

(i) a back portion comprising a plurality of lateral members connected by a plurality of uprights;

(ii) a first, second and third side portion extending generally orthogonally from the back portion, each side portion comprising a plurality of horizontal members connected by at least one upright, the first and third side portions extending from the lateral ends of the back portion;

(b) a receiver connected to each of the first and second side portions, for supporting, holding and dispensing a plurality of plastic bags;

(c) two suspending members, each attached to the second and third side portions, for capturing a hole in a bag positioned in the dispenser; and (d) at least one spring loaded hinge that separates the back portion of the frame from a side portion, which hinge has two flanges, one of which flanges is connected to the back portion and one of which flanges is connected to the side portion to allow the frame to flex when contacted by people or objects, and which flanges do not open beyond 90° so that the side portions of the frame do not flex beyond the point at which they are substantially parallel to one another.

* * * * *